US007950557B2

(12) United States Patent
Fujiyama et al.

(10) Patent No.: US 7,950,557 B2
(45) Date of Patent: May 31, 2011

(54) PNEUMATIC TOOL WITH AIR DUSTER

(75) Inventors: Takeo Fujiyama, Tokyo (JP); Tatsushi Ogawa, Tokyo (JP); Susumu Hayashi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 86 days.

(21) Appl. No.: 12/517,683

(22) PCT Filed: Dec. 7, 2007

(86) PCT No.: PCT/JP2007/073697

§ 371 (c)(1),
(2), (4) Date: Jun. 4, 2009

(87) PCT Pub. No.: WO2008/069316

PCT Pub. Date: Jun. 12, 2008

(65) Prior Publication Data

US 2010/0096428 A1 Apr. 22, 2010

(30) Foreign Application Priority Data

Dec. 7, 2006 (JP) ..... 2006-331192
Dec. 7, 2006 (JP) ..... 2006-331193

(51) Int. Cl.
*B25C 1/04* (2006.01)

(52) U.S. Cl. ..... 227/130; 227/8; 227/156

(58) Field of Classification Search ..... 227/130, 227/8, 156

See application file for complete search history.

(56) References Cited

U.S. PATENT DOCUMENTS

| | | | | | |
|---|---|---|---|---|---|
| 518,352 | A * | 4/1894 | Nightingale | 15/24 |
| 1,679,323 | A * | 7/1928 | Mortlock | 15/29 |
| 3,104,783 | A * | 9/1963 | Hall | 222/191 |
| 3,767,335 | A * | 10/1973 | Kramer et al. | 418/259 |
| 3,989,391 | A * | 11/1976 | Thorner | 401/43 |
| 4,091,577 | A * | 5/1978 | Ortiz | 451/359 |
| 4,102,084 | A * | 7/1978 | Bloomquist | 451/357 |
| 5,022,190 | A * | 6/1991 | Hutchins | 451/357 |
| 5,651,727 | A | 7/1997 | Weinstein et al. | |
| 6,783,050 | B2 * | 8/2004 | Ishizawa et al. | 227/130 |
| 7,115,018 | B1 * | 10/2006 | Syverson | 451/6 |
| 7,189,154 | B1 * | 3/2007 | Karppinen et al. | 451/449 |
| 7,322,505 | B2 * | 1/2008 | Ishizawa et al. | 227/130 |
| 2004/0026477 | A1 * | 2/2004 | Ishizawa et al. | 227/130 |

(Continued)

FOREIGN PATENT DOCUMENTS

CN 1253862 A 5/2000

(Continued)

*Primary Examiner* — Brian D Nash
(74) *Attorney, Agent, or Firm* — Drinker, Biddle & Reath LLP

(57) ABSTRACT

An air duster duct is formed to branch off at an intermediate portion along the length of an air duct which connects a compressed air supply source with a pneumatic tool. A valve mechanism having a selector valve and an operating device is provided at the branch portion. The sector valve can shift to a first position where the selector valve opens an upstream side duct which communicates with the air supply source to a downstream side duct which communicates with a nailing machine and shuts the upstream side duct relative to the air duster branch duct and a second position where the selector valve shuts the upstream side duct relative to the down stream side duct and opens the upstream side duct to the branch duct. The selector valve is operated from the outside by the operating device.

11 Claims, 16 Drawing Sheets

U.S. PATENT DOCUMENTS

2010/0116865 A1* 5/2010 Ogawa et al. ..... 227/130

FOREIGN PATENT DOCUMENTS

| | | |
|---|---|---|
| JP | 4-17067 | 2/1992 |
| JP | 11-179677 | 7/1999 |
| JP | 2001-162555 | 6/2001 |
| JP | 3385875 | 1/2003 |
| JP | 2004-1135 | 1/2004 |
| JP | 2004-1136 | 1/2004 |

* cited by examiner

PNEUMATIC TOOL WITH AIR DUSTER

TECHNICAL FIELD

The present invention relates to a pneumatic tool with an air duster in which an air duster for forcing compressed air out is attached additionally to a pneumatic tool such as a nailing machine.

BACKGROUND ART

For example, there happens a case where fine wood chips or shavings are found to be left on base sheets of floor materials during work of driving nails into the base sheets when making a floor. When finishing materials are laid over the base sheets with those fine wood chips or shaving left thereover as they are and then driving nails into the base sheets, the finishing materials are nailed down while being partially separated from the base sheets due to the wood chips or shavings left on the base sheets, resulting in floor making work having to be performed again. In order to prevent the occurrence of such inconveniences, finishing materials were set after surfaces of base sheets had been cleaned by an air duster for nailing work. However, since the air duster was provided separately from the nailing machine, when a large number of finishing materials were nailed down, since the nailing machine and the air duster had to be handled alternately, the nailing work was very troublesome.

Then, as a means for eliminating these inconveniences, there have been known nailing machines having an air duster provided thereon (refer to Patent Document 1). According to such nailing machines, since the nailing machine and the air duster do not have to be handled alternately every time wood dust has to be removed, the nailing machine with the air duster is convenient in this respect.

Patent Document 1: Japanese Patent No. 3385875
Patent Document 2: JP-A-2004-1135
Patent Document 3: JP-A-2004-1136

However, the aforesaid air duster fitted nailing machines had the following drawbacks. (1) An operating part for the air duster is provided on the body, so that an actuation trigger lever can be operated at the same time as the air duster is being used. In addition, since a construction is adopted in which compressed air for the air duster is taken out from a main chamber (an accumulating chamber) for nail driving, when the air duster operating part and the trigger lever are operated at the same time, the nailing machine is driven in such a state that the main chamber is at low pressure, thereby causing problems that nail driving failures occur due to insufficient outputs and that a driving piston cannot be returned to its initial position. (2) Since the construction is adopted in which compressed air for the air duster is taken out from the main chamber, oil supplied to a nailing machine main body and containing dirt in an engine part is discharged together with the compressed air from a nozzle, and the dirty oil so discharged adheres to finishing materials, whereby the finishing materials become dirty. (3) In particular, in the case of highly pressurized air, since air pressure discharged is high, there is caused a fear that wood chips or shavings may be blown up more than necessary. Because of this, there are nailing machines in which a pressure reducing valve is installed in an air duct which communicates with the nozzle (refer to Patent Document 3). However, this increases the number of components and configures major factors for increase in the weight and production costs of the nailing machine. (4) Since a button for the air duster and the actuation trigger lever of the nailing machine are positioned relatively close to each other, nailing work can be performed while using the air duster, leading to a danger of occurrence of an accident.

DISCLOSURE OF THE INVENTION

One or more embodiments of the invention provide a pneumatic tool with an air duster which can disable the driving of the pneumatic tool during the use of the air duster and enable a good operation of the pneumatic tool at all times irrespective of the use of the air duster.

According to a first aspect of the invention, a pneumatic tool with an air duster includes an air duster duct which is formed to branch off at an intermediate portion along the length of an air duct which connects an air supply source of compressed air with the pneumatic tool and a valve mechanism which is provided at the branching portion and which includes a selector valve capable of shifting to a first position where the selector valve opens an upstream side duct communicating with the air supply source to a downstream side duct communicating with the pneumatic tool and shuts the upstream side duct relative to the air duster branch duct and a second position where the selector valve shuts the upstream side duct relative to the downstream side duct and opens the upstream side duct to the branch duct and an operating member which operates the selector valve from the outside.

According to a second aspect of the invention, the selector valve may be a cylindrical valve which is disposed slidably in an interior of a valve housing which defines an air passage which communicates at its ends with the air duct and the branch duct, and the operating means may be a valve stem which is fitted slidably in an interior of the selector valve and in which an operating portion at one end thereof penetrates through the valve housing to project to the outside so as to selectively open a space formed at one end side of the selector valve to the upstream side duct or the atmosphere to thereby cause the selector valve to shift to the first position or the second position.

According to a third aspect of the invention, a filter may be provided in the branch duct.

According to a fourth aspect of the invention, a large diameter portion and a small diameter portion may be provided on an outer circumferential surface of the selector valve, so that the downstream side duct is made to open midway between the large diameter portion and the small diameter portion. In addition, when the upstream side duct is made to open to the atmosphere in such a state that the selector valve is situated as a result of operation of the valve stem in the position where the selector valve shuts the upstream side duct relative to the downstream side duct and opens the upstream side duct to the branch duct, a residual pressure in the downstream side duct may be made to act on the large diameter portion and the small diameter portion to thereby cause the selector valve to shift to the first position side.

According to a fifth aspect of the invention, a large diameter portion and a small diameter portion may be formed on an outer circumferential surface of the valve stem in a slight difference in diameter, an end portion of the valve stem at a side closer to the small diameter portion may be made to open to the atmosphere at an opposite side to the operating portion of the valve stem, and when compressed air from the upstream side duct is supplied between the large diameter portion and the small diameter portion in the midst of the valve stem being pushed in by the operating portion, a load against the push-in of the valve stem may be made small.

According to a sixth aspect of the invention, a lock mechanism may be provided for locking the valve stem in a state in which the valve stem has been slid to be operated.

According to a seventh aspect of the invention, a compressed air outlet nozzle of the air duster may be provided rotatably about an axis of the branch duct.

According to an eighth aspect of the invention, compressed air from the outlet nozzle of the air duster may be made to be forced out to the periphery of a working range at a distal end portion of the pneumatic tool.

According to a ninth aspect of the invention, a pneumatic tool with an air duster includes an air duster duct which is formed to branch off at an intermediate portion along the length of an air duct which connects an air supply source of compressed air with the pneumatic tool and a valve mechanism which is provided at the branching portion and which includes a first selector valve which opens and closes an upstream side duct communicating with the air supply source relative to a downstream side duct communicating with the pneumatic tool and a second selector valve which opens and closes the upstream side duct relative to the air duster branch duct in such a state that the first selector valve shuts the upstream side duct relative to the downstream side duct.

According to a tenth aspect of the invention, the first selector valve and the second selector valve may be provided in such a manner as to be operated from the outside.

According to an eleventh aspect of the invention, when the first selector valve shuts the upstream side duct relative to the downstream side duct, the downstream side duct may be made to open to the atmosphere.

According to a twelfth aspect of the invention, a filter may be provided in the branch duct.

According to the first aspect of the invention, since the air duster branch duct is disposed before the pneumatic tool, the operating means of the air duster and the actuation trigger lever are made difficult to be operated at the same time. In addition, since the compressed air from the air supply source is supplied to only either the pneumatic tool or the air duster by the selector valve, there is no situation where the nail driving operation is performed in such a state that the nail driving air pressure is low. Consequently, since neither nail driving failure nor driving piston's return failure is caused by the lack of output, nails can be driven well at all times irrespective of the use of the air duster.

In addition, the selector valve is made to shift to either the first position where the selector valve opens the upstream side duct communicating with the air supply source to the downstream side duct communicating with the pneumatic tool and shuts the upstream side duct relative to the air duster branch duct or the second position where the selector valve shuts the upstream side duct relative to the downstream side duct and opens the upstream side duct to the branch duct, whereby since the supply of compressed air to the pneumatic tool is cut off while compressed air is being supplied to the air duster, an unforeseen accident is made difficult to occur.

According to the second aspect of the invention, since the operating means is the valve stem and the selector valve is allowed to shift to the first position or the second position by supplying or discharging compressed air to or from the space formed at the one end side of the selector valve, the switching of compressed air can be implemented quickly.

According to the third aspect of the invention, when it is initially used, oil is supplied to the pneumatic tool for lubrication and prevention of rust. However, since compressed air is supplied directly to the air duster branch duct from the air supply source, there is no situation where the air duster gets dirty from the oil content. Even though the oil content or dirt is mixed into the air duster, since the filter is provided in the branch duct, compressed air is filtered by the filter. Because of this, even though compressed air is blown against an object material, there is no situation where the oil content or dirt adheres to a surface of the object material.

In addition, since the filter has a function to adjust the flow rate of compressed air, air under an appropriate pressure can be forced out from the air duster without providing any special pressure reducing valve.

According to the fourth aspect of the invention, with the selector valve located as a result of operation of the valve stem in the position where the upstream side duct is shut relative to the downstream side duct and is opened to the branch duct, when the upstream side duct is made to open to the atmosphere, the residual pressure in the downstream side duct is made to act on the larger diameter portion and the small diameter portion to thereby cause the selector valve to be operated to the first position side, whereby compressed air remaining in the pneumatic tool is discharged to the atmosphere. Consequently, even after the upstream side duct is separated from the air supply source to be opened to the atmosphere with the valve stem operated to be pushed in, when compressed air remains in the pneumatic tool, there exists a possibility that the pneumatic tool operates. However, even in such a case, since the selector valve is operated to the first position so that the residual pressure is released to the atmosphere from the upstream side duct, there is no situation where the pneumatic tool is operated, which is safe.

According to the fifth aspect of the invention, when compressed air from the upstream side duct is supplied between the large diameter portion and the small diameter portion in the midst of the valve stem being pushed in by the operating portion, since the difference in diameter between the large diameter portion and the small diameter portion is slight, the load resisting the push-in of the valve stem is small. Consequently, even though compressed air supplied from the upstream side duct is high in pressure, the operation of the valve stem can easily be performed.

According to the sixth aspect of the invention, since the lock mechanism is provided which locks the valve stem in the state where it has been slid to be operated, the air duster can be used for a long period of time without continuing to press the valve stem 3.

According to the seventh aspect of the invention, since the compressed air outlet nozzle of the air duster is provided in such a manner as to rotate about the axis of the branch duct, the direction in which compressed air is forced out from the air duster can freely be changed.

According to the eighth aspect of the invention, since compressed air from the outlet nozzle of the air duster is made to be forced out to the periphery of the working range of the distal portion of the pneumatic tool, air can be blown to an accurately aimed position, so as to enhance the working properties.

According to the ninth aspect of the invention, since compressed air from the air supply source is supplied to only either the pneumatic tool or the air duster by the selector valve mechanism, there is no situation where nailing work is performed in such a state that the nail driving air pressure is low. Consequently, since neither nail driving failure nor driving piston's return failure is caused by the lack of output, nails can be driven well at all times irrespective of the use of the air duster.

In addition, since the air duster branch duct is disposed before the pneumatic tool, the selector valve mechanism and the actuation trigger lever are made difficult to be operated at the same time. In addition, when attempting to use the air duster, since the third selector valve has to be operated to shut the upstream side duct communicating with the air supply source relative to the downstream side duct communicating with the pneumatic tool and further the upstream side duct has to be opened to the air duster branch duct by the fourth selector valve, an unforeseen accident is made difficult to occur, which is safe.

According to the tenth aspect of the invention, the third selector valve and the fourth selector valve have to be operated individually from the outside to use the air duster. In this way, the two-stage operation of the valves becomes necessary, there is no situation where the valve mechanism is put in operation easily, whereby the safety is enhance.

According to the eleventh aspect of the invention, since the downstream side duct is made to open to the atmosphere when the third selector valve shuts the upstream side duct relative to the downstream side duct, compressed air remaining in the pneumatic tool is released to the atmosphere. Even after the upstream side duct is separated from the air supply source to be released to the atmosphere with the third selector valve operated, when compressed air remains in the pneumatic tool, the pneumatic tool can be caused to be operated. However, even as this occurs, since the residual pressure is released to the atmosphere from the downstream side duct by the third selector valve and the pneumatic tool cannot perform the nail driving operation by the residual pressure, safety can be ensured.

According to the twelfth aspect of the invention, oil is supplied to the pneumatic tool when it is initially used for lubrication and prevention of rust. However, since compressed air from the air supply source is supplied directly to the air duster branch duct, there is no situation where the air duct gets dirty from oil contents. Even though oil contents or dirt is mixed into the air duster, since the filter is provided in the branch duct, compressed air is filtered by the filter. Because of this, even though compressed air is blown against the object material, there is no situation where oil contents or dirt adheres to the surface of the object material.

In addition, since the filter has the function to regulate the flow rate of compressed air, air under the appropriate pressure can be forced out from the air duster without providing any special pressure reducing valve.

Other features and advantages of the invention will be apparent from the description of an embodiment and appended claims.

BEST MODE FOR CARRYING OUT THE INVENTION

Figure 1:
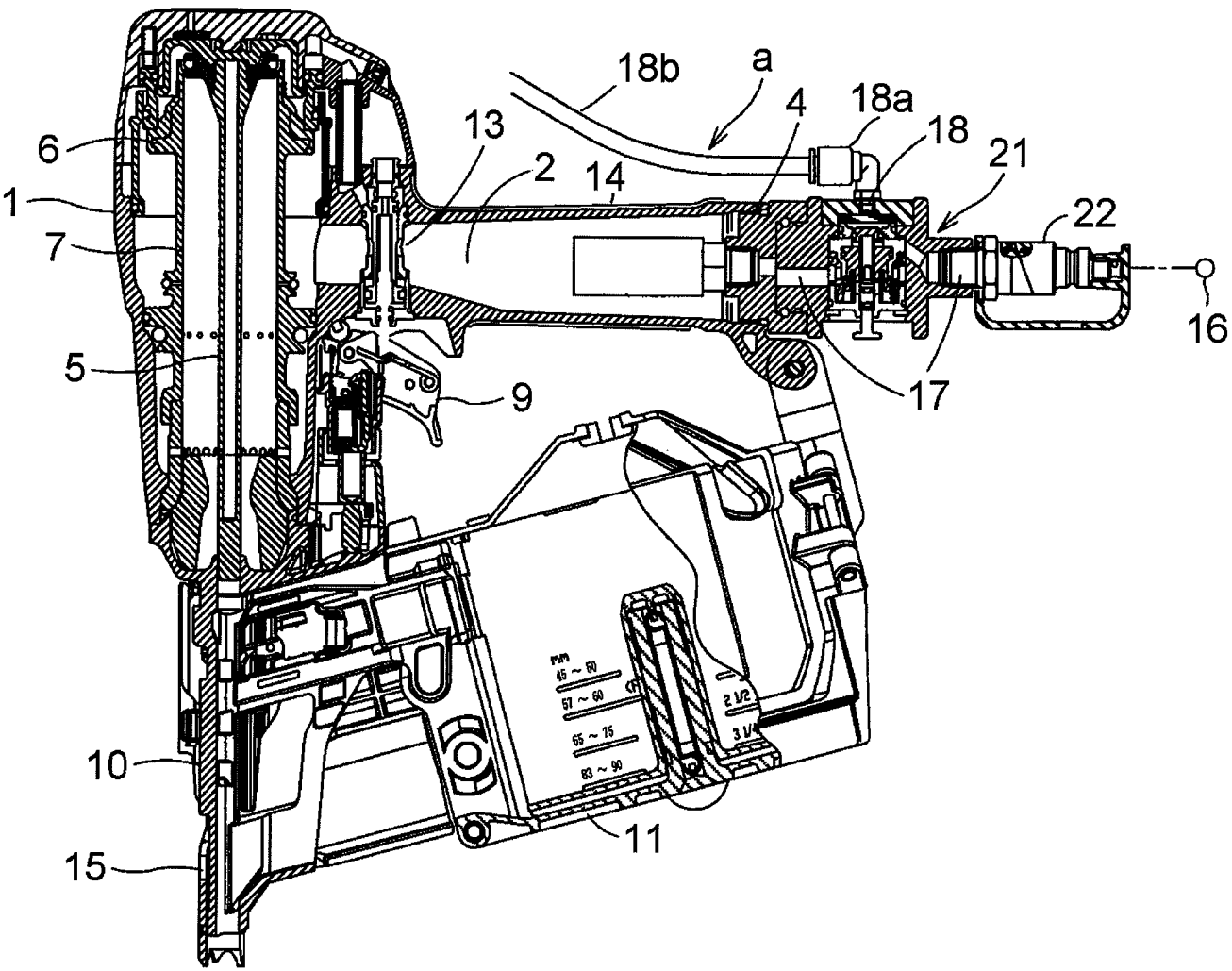
FIG. 1 is a vertical sectional view of a nailing machine according to an embodiment of the invention.

Hereinafter, an embodiment of a pneumatic tool according to the invention will be described based on the drawings using a nailing machine.

A hitting mechanism made up of a hitting piston 6 with which a driver 5 for hitting a nail by making use of compressed air accumulated within an air chamber 2 is integrally connected and a hitting cylinder 7 which accommodates the hitting piston 6 slidably or the like is provided in a nailing machine main body 1 of the nailing machine, and a nose part 10 is provided below the nailing machine main body 1 which accommodates the hitting mechanism. A magazine 11 is installed consecutively at the rear of the nose part 10 via an opening. Nails within the magazine 11 are configured to be fed sequentially to an inside of the nose part 10 by a nail supply mechanism (not shown).

In addition, a trigger valve 13 is provided in the nailing machine man body 1 for driving the hitting mechanism so as to drive the hitting piston 6 by introducing compressed air within the air chamber 4 into the hitting cylinder 7 so as to activate the nailing machine. This trigger valve 13 is configured in such a manner as to introduce compressed air into the hitting cylinder 7 so as to drive the hitting piston 6 to thereby drive a nail within the nose part 10 out thereof by driving the hitting mechanism through two operations of pulling a trigger lever 9 which is disposed at a lower portion of a grip part 14 and pressing a contact arm 15 against a surface of a material into which nails are to be driven.

Next, compressed air is configured in such a manner as to be taken into the air chamber 4 via an opening at an end portion of the grip part 14 from an air supply source 16 such as an air compressor through an air duct 17. Then, a duct 18 which communicates with an air duster a via a selector valve mechanism (a valve mechanism) is formed in such a manner as to branch off at an intermediate portion along the length of the air duct 17. The air duster branch duct 18 is made up of a tubular metal instrument 18*a*, an air tube 18*b* and a compressed air outlet nozzle (not shown) at a distal end thereof, and is held in an appropriate position on the nailing machine. Consequently, since cleaning can be performed with air tube 18*b* held by the operator, good working properties are provided.

Figure 2:
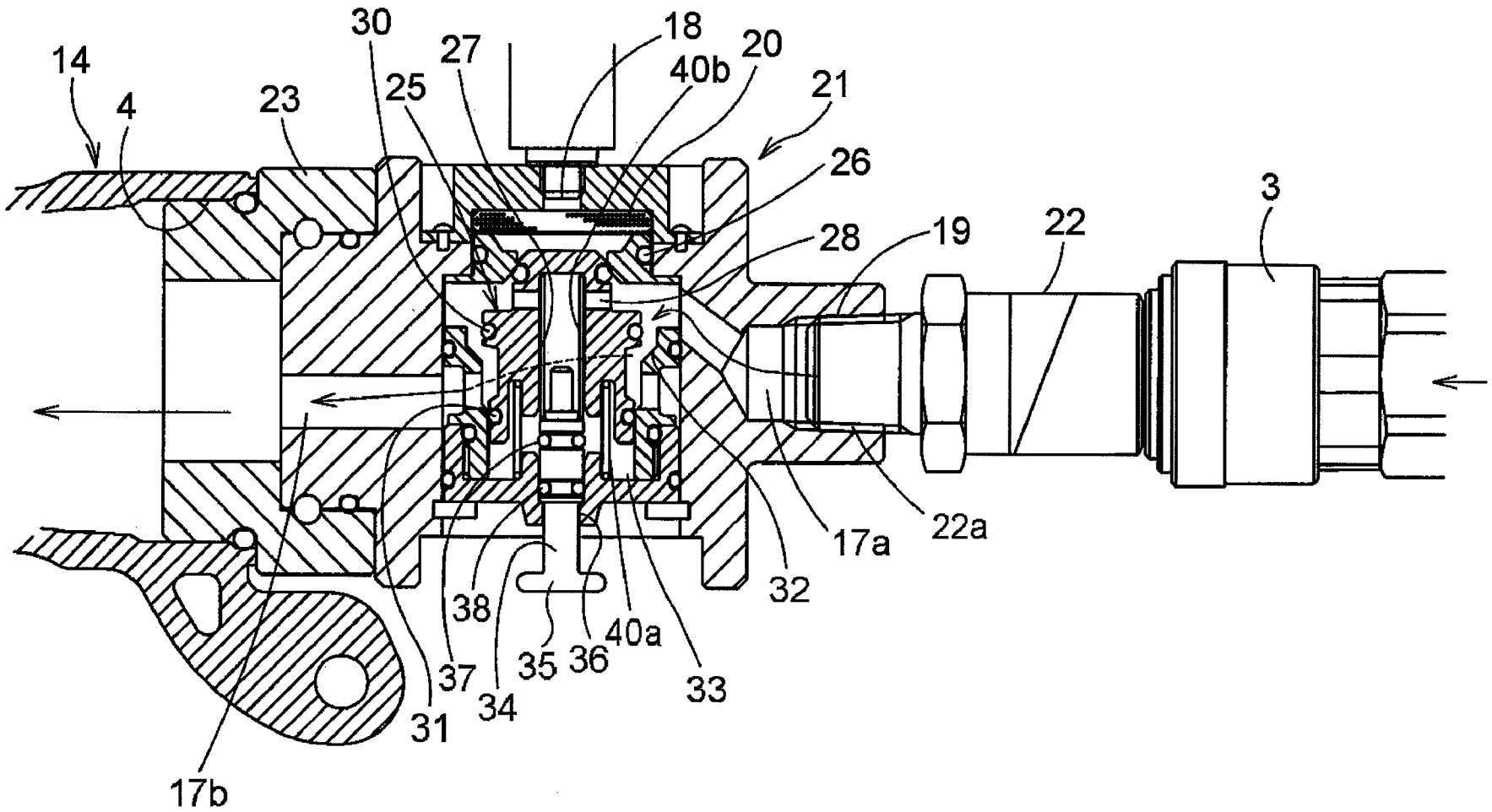
FIG. 2 is an enlarged sectional view of an initial state of a selector valve mechanism.

The selector valve mechanism is provided in a valve housing 21 at the branch portion of the air duct. Specifically, as is shown in FIG. 2, a female screw portion 19 which can be screwed on to a thread portion 22*a* of an air plug 22 which connects to an air coupler 3 provided at an end portion of the air duct 17 from the air supply source 16 is formed at one end of the valve housing 21, and the other end 23 is formed in such a manner as to be connected to the opening in the grip part 14, the air duster branch duct 18 being formed at an intermediate upper portion thereof in such a manner as to branch off thereat. A filter 20 is provided at a proximal portion of the air duster branch duct 18.

A selector valve 25 is disposed in a central portion of the valve housing 21. This selector valve 25 is a cylindrical valve, and in the figure, an upper portion thereof is provided in such a manner as to come into abutment with and go away from an opening of the branch duct 18 via an O ring 26. A sliding hole 27 is formed in a central portion of the selector valve 25 in such a manner as to be made to open downwards. A passage 28 is formed in an upper portion of the siding hole 27 in such a manner as to penetrate therethrough sideways.

In addition, a large diameter portion and a small diameter portion is formed on an outer circumferential surface of the selector valve 25, and an O ring 30 and an O ring 31 are provided circumferentially on the large diameter portion and the small diameter portion, respectively. The O ring 30 is provided in such a manner as to come into abutment with and go away from a blowpipe portion 32 formed below the branch duct 18. The downstream side duct 17*b* is formed in such a manner as to be opened midway between the O ring 30 and the O ring 31 when the O ring 30 is brought into abutment with the blowpipe portion 32. Further, when the selector valve 25 shifts upwards in the figure, a space (an under-valve chamber) 33 is made to be formed between the selector valve 25 and a bottom portion of the valve housing 21.

The selector valve 25 is provided so as to shift to an upper first position (a position in FIG. 2) and a lower second position (a position in FIG. 3) and is biased upwards by a spring 40*a*. The selector valve 25 is configured in such a manner that when in the upper first position, the selector valve 25 opens an upstream side duct 17*a* which communicates with the air supply source 16 to the downstream side duct 17*b* which communicates with the nailing machine and shuts the upstream side duct 17*a* relative to the air duster branch duct 18, while when in the lower second position, the selector valve 25 shuts the upstream side duct 17*a* relative to the downstream side duct 17*b* and opens the upstream side duct 17*a* to the branch duct 18.

Next, a valve stem (an operating member) 34, which controls the operation of the selector valve 25 and which can be operated from the outside, is disposed in an interior of the selector valve 25. This valve stem 34 is fitted slidably in a sliding hole 27 formed in the interior of the selector valve 25, and an operating button 35 at one end of the valve stem 34 passes through a guide hole 36 in the valve housing 21 to thereby project to the outside. In addition, O rings 37, 38 are provided vertically at an intermediate portion of the valve stem 34. Then, when the valve stem 34 shifts upwards, the upper O ring 37 is made to enter the sliding hole 27 to seal it and at the same time, the lower O ring 38 is made to exit from the guide hole 36 to unseal it. In addition, when the valve stem 34 shifts downwards, the upper O ring 37 is made to exit from the sliding hole 27 to unseal it and at the same time, the lower O ring 38 is made to enter the guide hole 36 to seal it. The valve stem 34 is normally biased downwards by a spring 40*b* which is disposed thereabove.

According to the configuration that has been described above, normally, as is shown in FIG. 2, the valve stem 34 is caused to lie in a lower position by the spring 40*b*, and a lower end portion thereof projects from the bottom portion of the valve housing 21. In this state, since the upper O ring 37 exits from the sliding hole 27 to unseal it and at the same time, the lower O ring 38 enters the guide hole 36 to seal it, compressed air supplied from the upstream side duct 17*a* is supplied from an upper passage 28 of the selector valve 25 to the under-valve chamber 33 along the outer circumferential surface of the valve stem 34. Because of this, the air pressure in the under-valve chamber 33 is increased to thereby cause the selector valve 25 to shift upwards to the first position, whereby the selector valve 25 opens the upstream side duct 17*a* to the downstream side duct 17*b* which communicates with the nailing machine and shuts the same duct relative to air duster branch duct 18, thereby making it possible to actuate the nailing machine.

Figure 3:
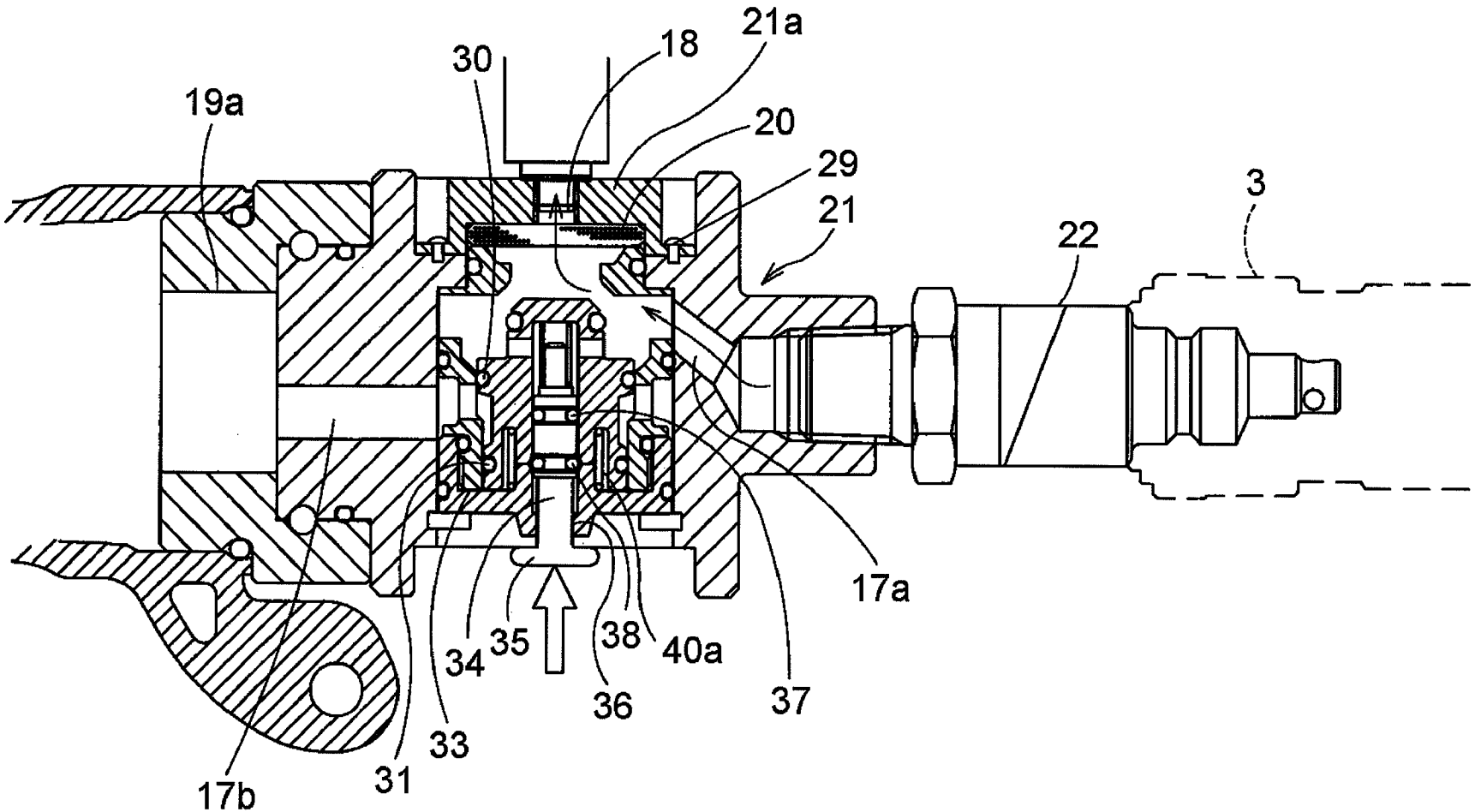
FIG. 3 is a sectional view depicting a state in which an upstream side duct is opened to an air duster and is shut to a downstream side duct.

In contrast to this, when the air duster a is used, as is shown in FIG. 3, the operating button 35 of the valve stem 34 is pushed in so as to be shifted upwards. By this, the upper O ring 37 of the valve stem 34 enters the sliding hole 27 to seal it and at the same time, the lower O ring 38 exits from the guide hole 36 to unseal it, whereby compressed air within the under-valve chamber 33 is released to the atmosphere from the guide hole 36. Because of this, since the selector valve 25 shifts downwards to the second position, the upper O ring 37 shifts away from the branch duct 18 and at the same time the O ring 30 at the large diameter portion is brought into abutment with the blowpipe portion 32, whereby the upstream side duct 17*a* is made to open to the branch duct 18 and at the same time, is automatically shut relative to the downstream side duct 17*b*. Consequently, the air duster can be used. As this occurs, even in the event that compressed air remains in the interior of the nailing machine, since the nailing machine is in a cut-off state from the outside, there is no situation where the compressed air so remaining is released to the outside.

In either of the cases, since the selector valve 25 is caused to shift to the first position or the second position by operating the valve stem 34 so as to supply or discharge compressed air to or from the under-valve chamber 33, the switching of compressed air can be implemented quickly.

Incidentally, even after the air plug 22 is pulled out of the air coupler 3 with the valve stem 34 operated to be pushed in, when compressed air remains in the nailing machine, it means that the nailing machine is allowed to be actuated. In such a case, however, a residual pressure of the downstream side duct 17*b* which remains in the air chamber of the nailing machine acts on the O ring 30 at the large diameter portion and the O ring 31 at the small diameter portion, whereby because of the fact that a pressure receiving area of the O ring 30 at the large diameter portion is larger than that of the O ring 31 at the smaller diameter portion and addition of the force of the spring 40*a*, the selector valve 25 is operated to shift to the upper first position where the selector valve 25 opens the downstream side duct 17*b* to the upstream side duct 17*a*. Because of this, the aforesaid residual pressure is released to the atmosphere from the upstream side duct 17*a*. Consequently, since there is no situation where the nailing operation is activated by the residual pressure, safety is ensured.

Further, oil is supplied to the nailing machine for lubrication and prevention of rust when it is initially used. However, since compressed air is supplied from the air supply source 16 directly to the air duster branch duct 18, there is no situation where the air duster branch duct 18 gets dirty from oil contents. In addition, even though oil contents or dust exists in compressed air so supplied, since the filter 20 is provided in the branch duct 18, compressed air is filtered by the filter 20. Because of this, even when compressed air is blown against a material into which nails are to be driven, there is no situation where oil contents or dirt adheres to the surface of the material.

In addition, since the filter 20 has a function to regulate the flow rate of compressed air, air under an appropriate pressure is allowed to be forced out from the air duster without providing any special pressure reducing valve. In addition, when bolts 29 are loosened to remove an upper plate 21*a*, the filter 20 can be removed for replacement.

Additionally, the operating means does not have to be the valve stem, and hence, a configuration may be adopted in which the selector valve 25 is caused directly to shift to the first position and the second position.

Figure 4:
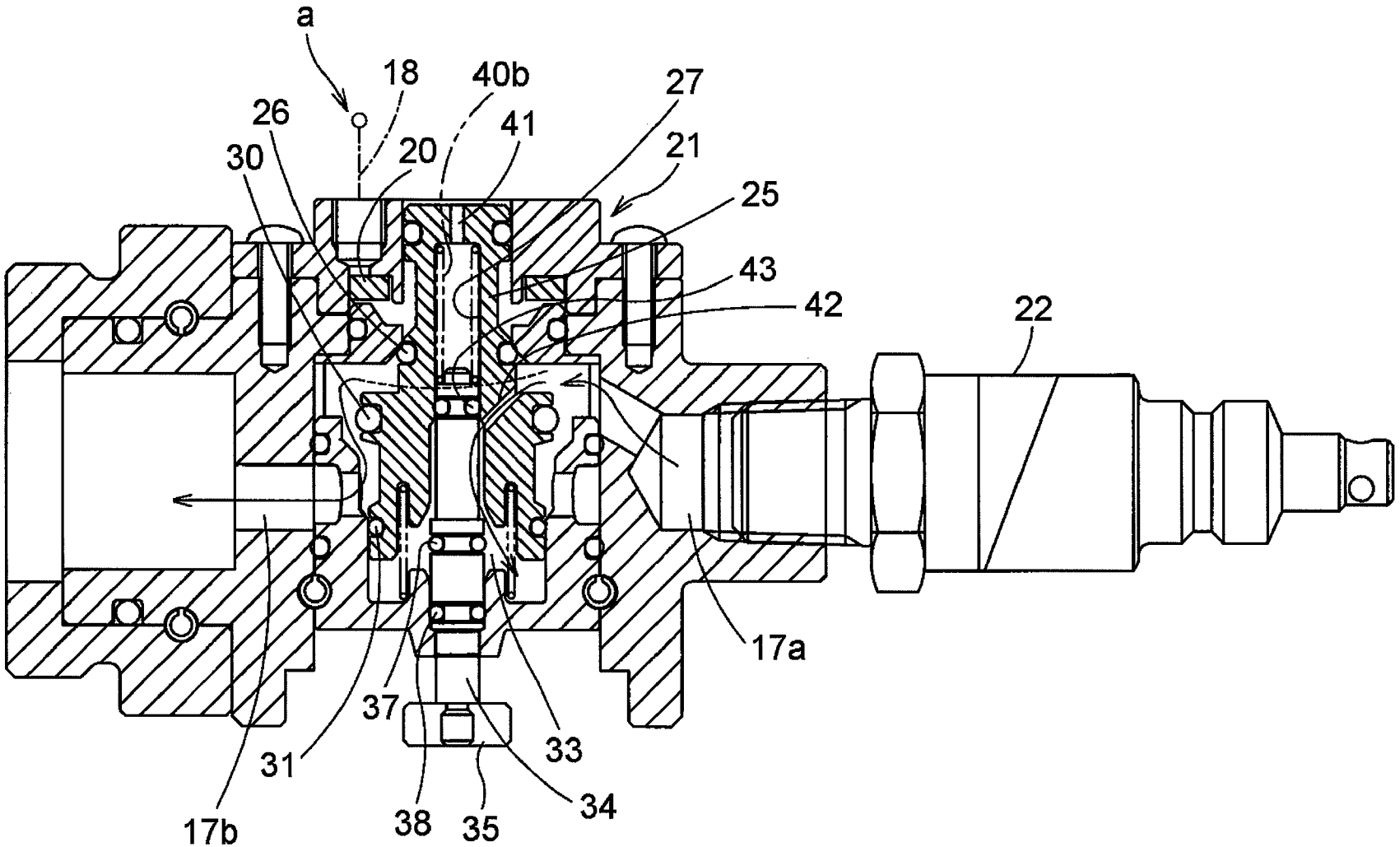
FIG. 4 is a sectional view depicting a state in which the upstream side duct is opened to the downstream side duct and is shut to the air duster in an initial state of another selector valve mechanism.

Next, FIG. 4 shows another embodiment of a valve mechanism. The valve mechanism has the same basic construction as that of the valve mechanism that has been described above, and like reference numerals will be given to like components.

In this valve mechanism, an air duster branch duct 18 is disposed in a position which is offset from the center of a valve housing 21, and an upper end of a valve accommodation space of the valve housing 21 is made to open to the atmosphere. To correspond to this configuration, a small hole 41 is formed at an upper end of a sliding hole 27 which is formed in the center of a selector valve 25. In addition, an outside diameter of the selector valve 25 is formed in such a manner that an outside diameter at an upper portion becomes smallest, a larger diameter portion is formed at an intermediate portion and a small diameter portion is formed at a lower end. An O ring 30 is provided circumferentially around the larger diameter portion and an O ring 31 is provided circumferentially around the small diameter portion. Similarly, an inside diameter of an upper portion of the sliding hole 27 in the selector valve 25 is formed in such a manner as to become smaller than an inside diameter of a lower portion thereof. Further, a communication hole 42 is formed in the selector valve 25 which establishes a communication from a portion above the O ring 30 at the large diameter portion to a lower portion of the sliding hole 27 which is formed into the large inside diameter portion.

An outside diameter of a valve stem 34 is formed in such a manner that a small diameter portion is formed at an upper portion, while a large diameter portion which is made slightly larger than the small diameter portion is formed at a lower portion. An O ring 43, which forms a seal with an inner surface of the sliding hole 27, is mounted at an upper end of the small diameter portion, and an upper O ring 37 and a lower O ring 38, which have the same diameter, are mounted on the large diameter portion as well. In addition, the valve stem 34 is biased so as to shift downwards by a spring 40*b* disposed thereabove.

According to the configuration that has been described above, since compressed air from the upstream side duct 17*a* passes through the communication hole 42 so as to be supplied into a under-valve chamber 33, the selector valve 25 lies in a first position due to the pressure of the compressed air, whereby since the upstream side duct 17*a* is made to open to a downstream side duct 17*b* and is shut relative to the branch duct 18, the nailing machine can be actuated.

Figure 5:
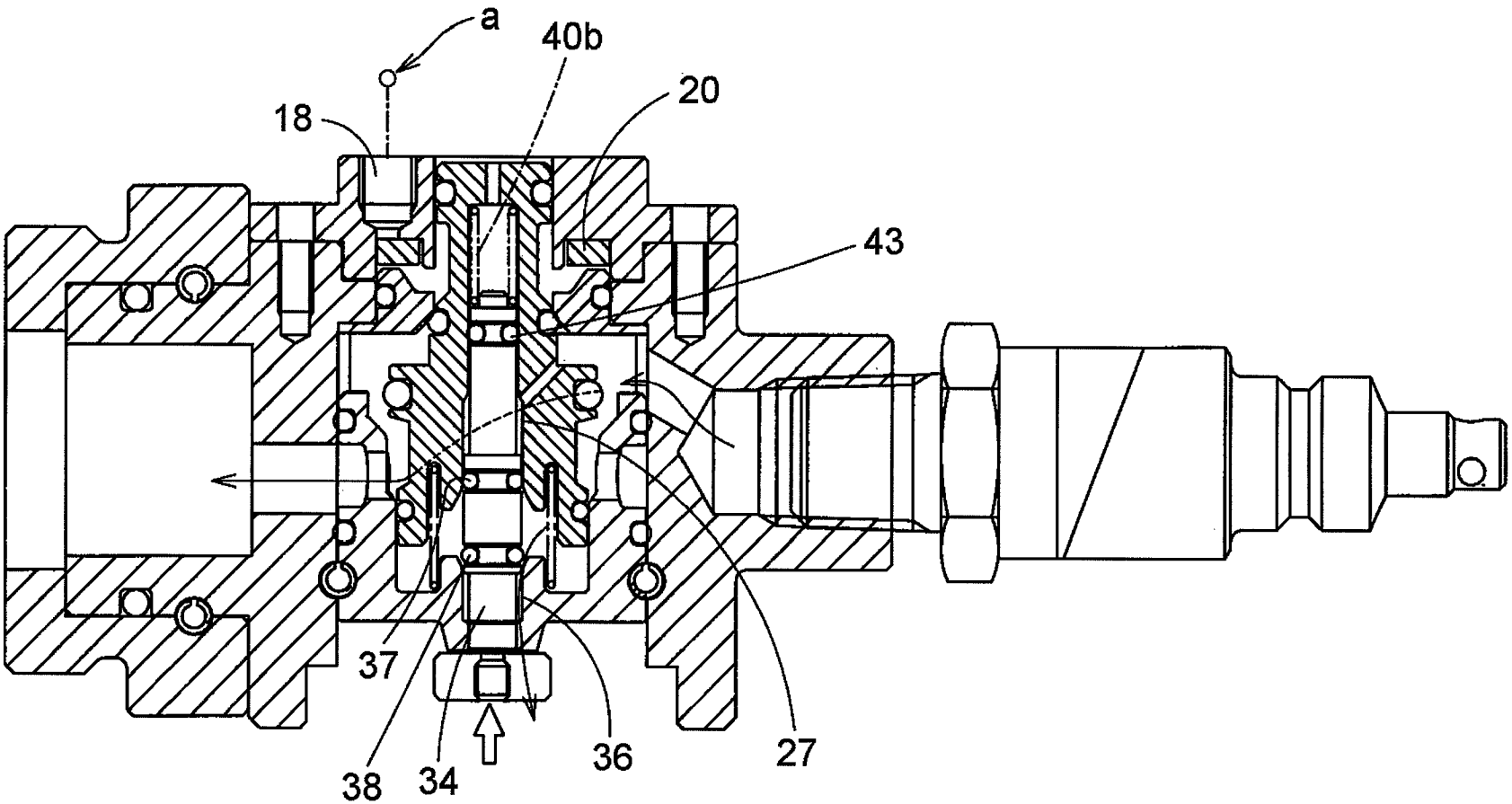
FIG. 5 is a sectional view depicting a state in which an operating button is pushed in by the selector valve mechanism.
Figure 6:
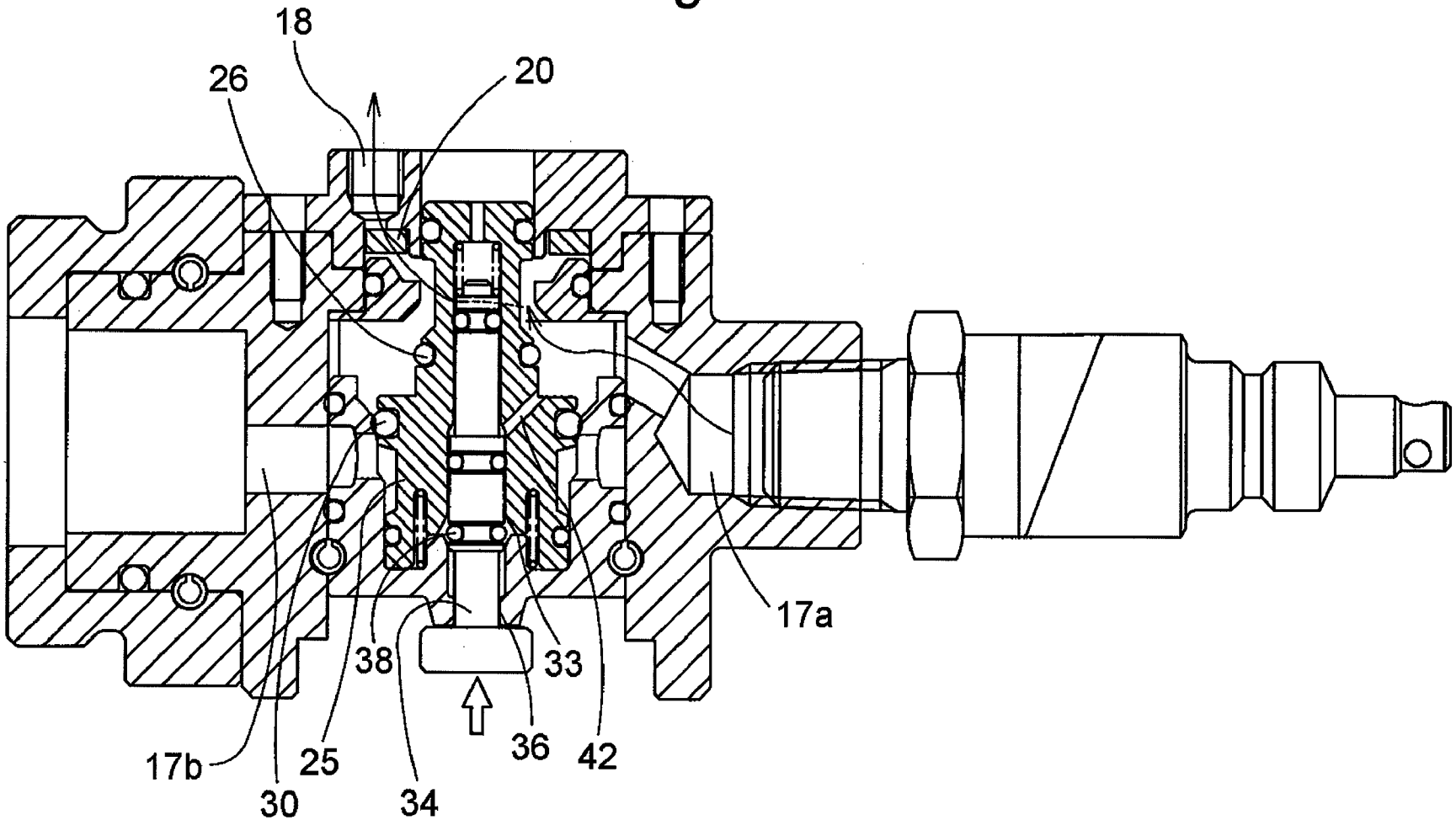
FIG. 6 is a sectional view depicting a state in which the upstream side duct is opened to the air duster and is shut to the downstream side duct by the selector valve mechanism.

When the air duster a is used, as is shown in FIG. 5, the valve stem 34 is pushed in upwards. By this action, since compressed air in the under-valve chamber 33 is released to the atmosphere from a guide hole 36, as is shown in FIG. 6, the selector valve 25 shifts to the lower second position, whereby since the O ring 30 shuts the upstream side duct 17*a* relative to the downstream side duct 17*b* and the O ring 26 opens the upstream side duct 17*a* to the branch duct 18, compressed air is supplied to an outlet nozzle of the air duster a.

In addition, after the air duster a has been used, when the hand is removed from the valve stem 34, the valve stem 34 returns to its original position, an initial state like one shown in FIG. 4 being thereby restored.

Thus, when the valve stem 34 is being pushed in upwards, initially, compressed air acts in such a manner as to push the O ring 43 up from therebelow, and therefore, the valve stem 34 can be pushed in with a small force. Then, as is shown in FIG. 5, when the O ring 37 is brought into abutment with an open end of the sliding hole 27, compressed air supplied from the communication hole 42 acts opposite on the O ring 43 and the O ring 37 in such a manner as to push the O ring 43 up and push the O ring 37 down and due to the difference in diameter, a larger force acts in the push-down direction. However, since the difference in diameter between the O ring 43 and the O ring 37 is slight, the force acting in the push-down direction is small. Consequently, the push-in load of the valve stem 34 is small, and even in the event that the pressure of compressed air supplied from the upstream side duct 17*a* is high, the operation of the valve stem 34 can easily be performed without using any special mechanism.

Figure 7A:
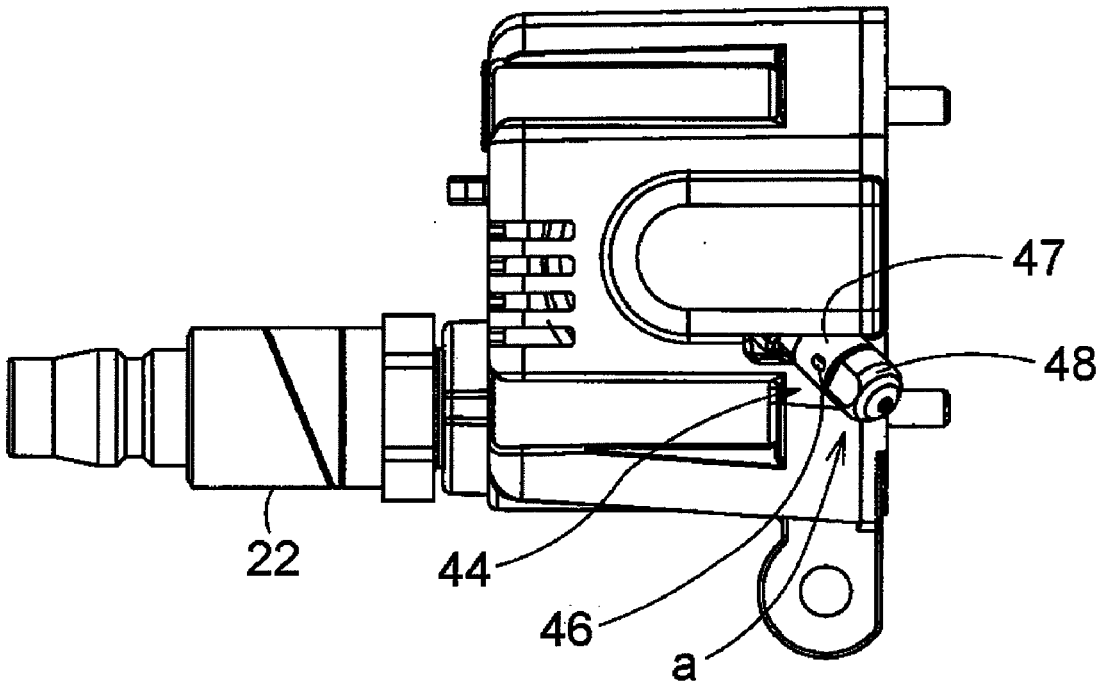
FIG. 7A is a plan view of the selector valve mechanism.
Figure 7B:
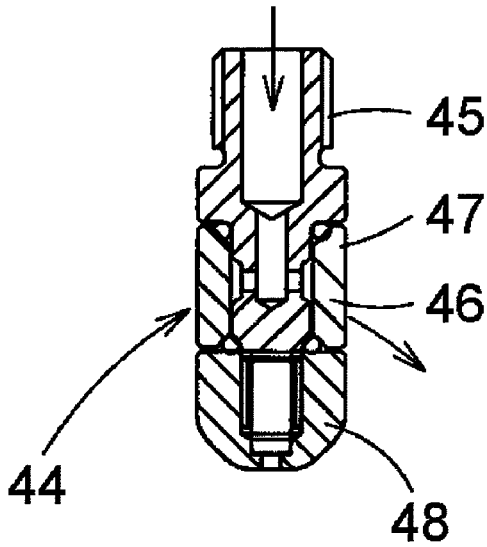
FIG. 7B is a vertical sectional view of a valve portion.

In addition, as is shown in FIGS. 7A, 7B, in a case where an outlet nozzle 44 of the air duster a is attached to a distal end of the branch duct 18 without using an air tube in the way described above, a configuration is adopted in which a plug 48 is attached to a tubular metal instrument 45 at an end portion of the branch duct 18 via an annular element 47 having an outlet port 46 of the nozzle and the annular element 47 is attached in such a manner as to rotate about an axis of the branch duct 18, whereby a direction in which compressed air is forced out from the air duster a can freely be changed.

Figure 8:
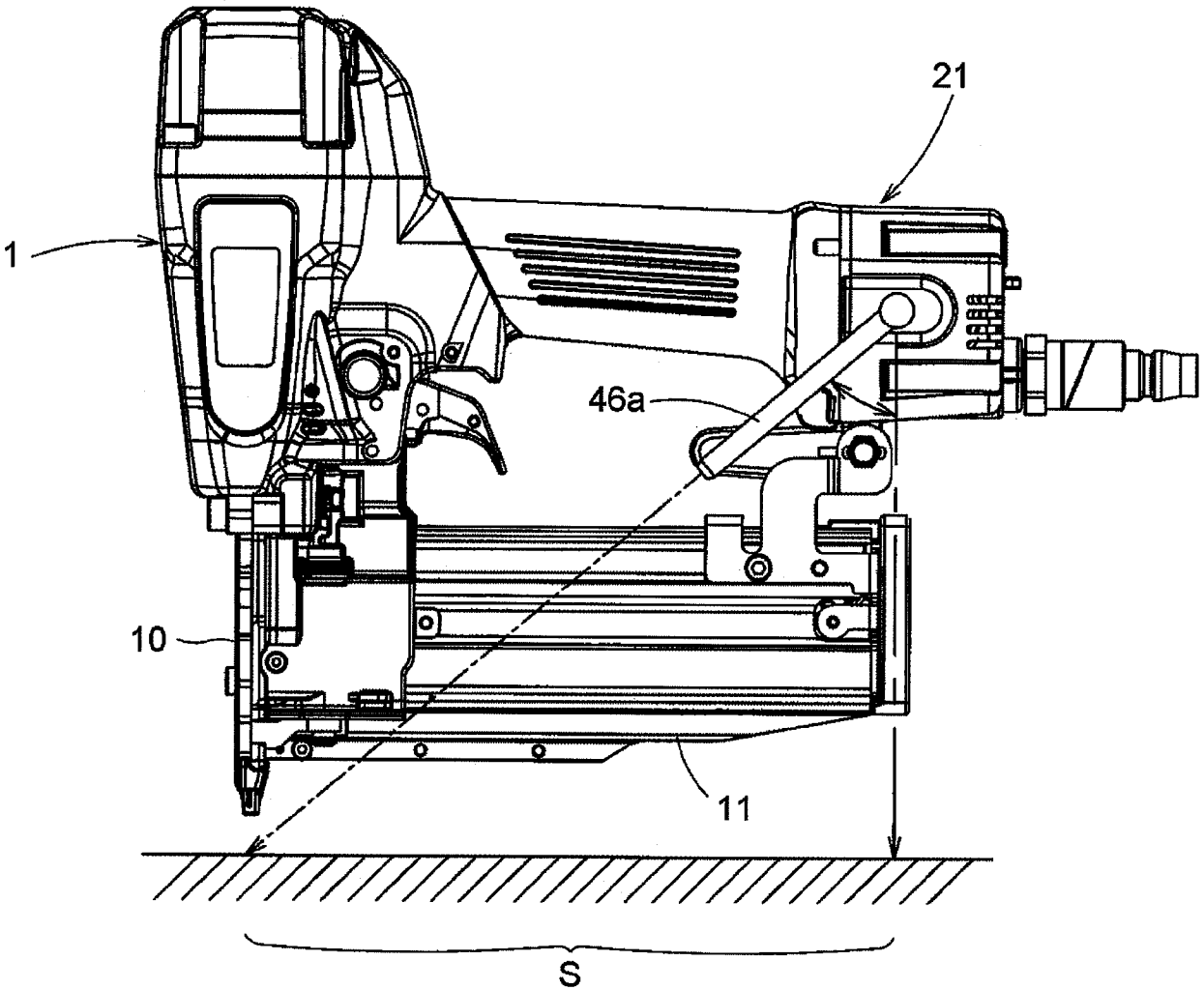
FIG. 8 is a side view of a nailing machine showing an example of a form in which air is forced out from the air duster.

Additionally, as is shown in FIG. 8, a (metallic) air outlet pipe 46*a* including a nozzle at a distal end thereof is preferably provided rotatably on a side portion of the valve housing 21 so as to enable compressed air to be forced out to the periphery of a working range S from a distal end portion of a nose part 10 to a rear end portion of a magazine 11 of the nailing machine. According to this configuration, since air can be blown accurately to an aimed position, the working properties are enhanced.

The rotation of the air outlet pipe 46*a* preferably takes the form of a rotation which is restricted within a constant limit such as a slightly tight rotation or a click rotation in which the air outlet pipe 46*a* rotates bit by bit through a constant angle.

Figure 9:
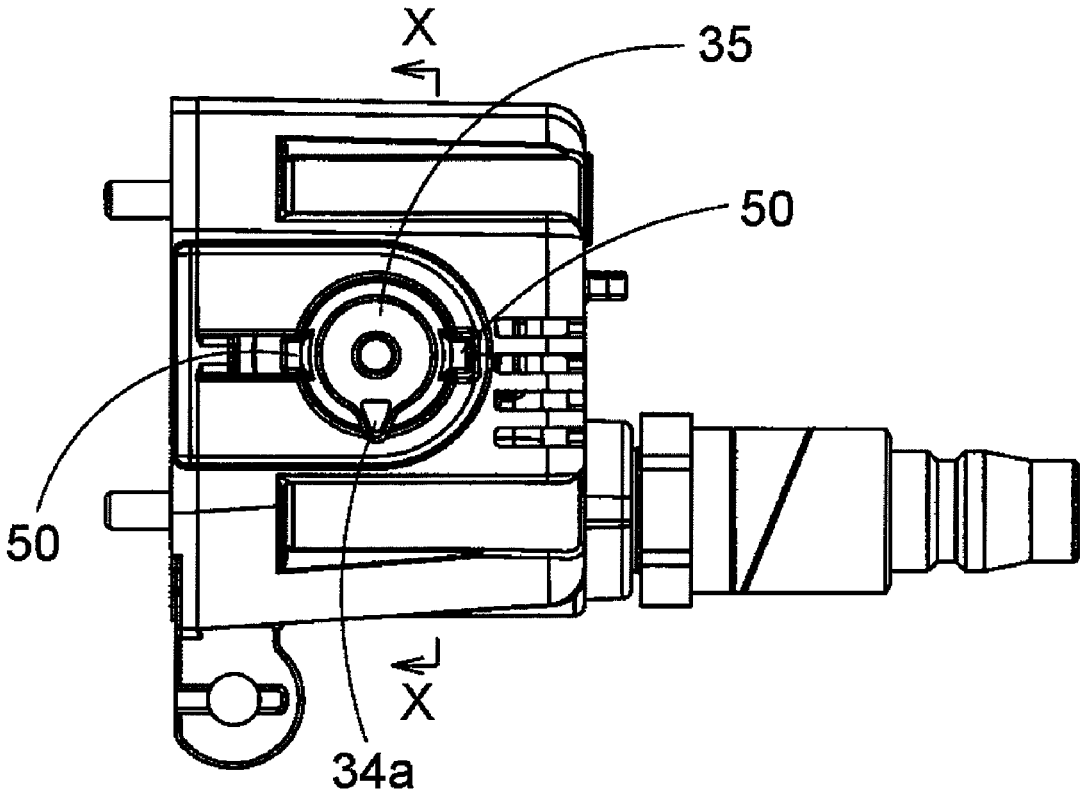
FIG. 9 is a bottom view of the selector valve mechanism depicting a lock mechanism of a valve stem.
Figure 10A:
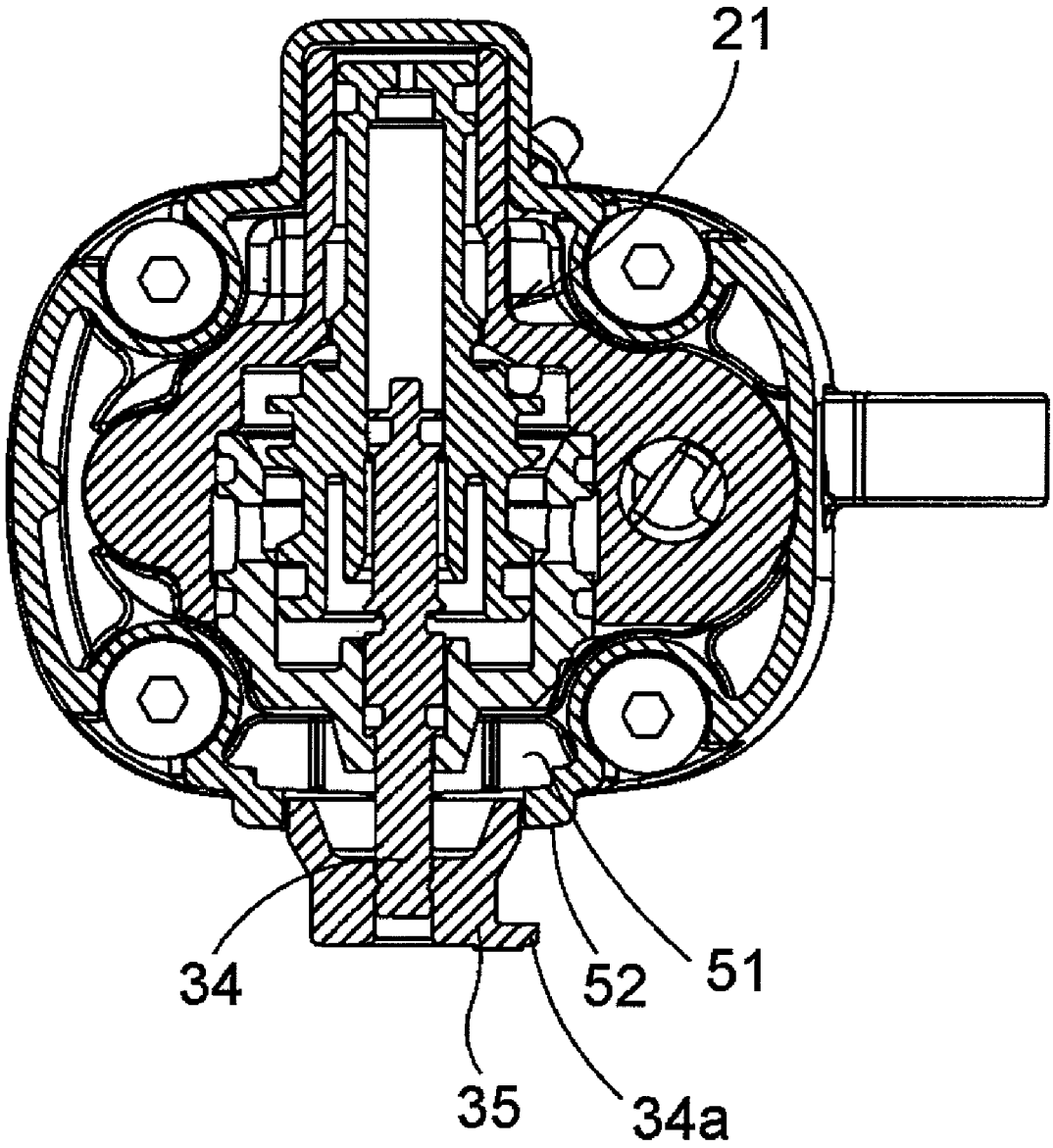
FIG. 10A is a sectional view taken along the line X-X in FIG. 9.
Figure 10B:
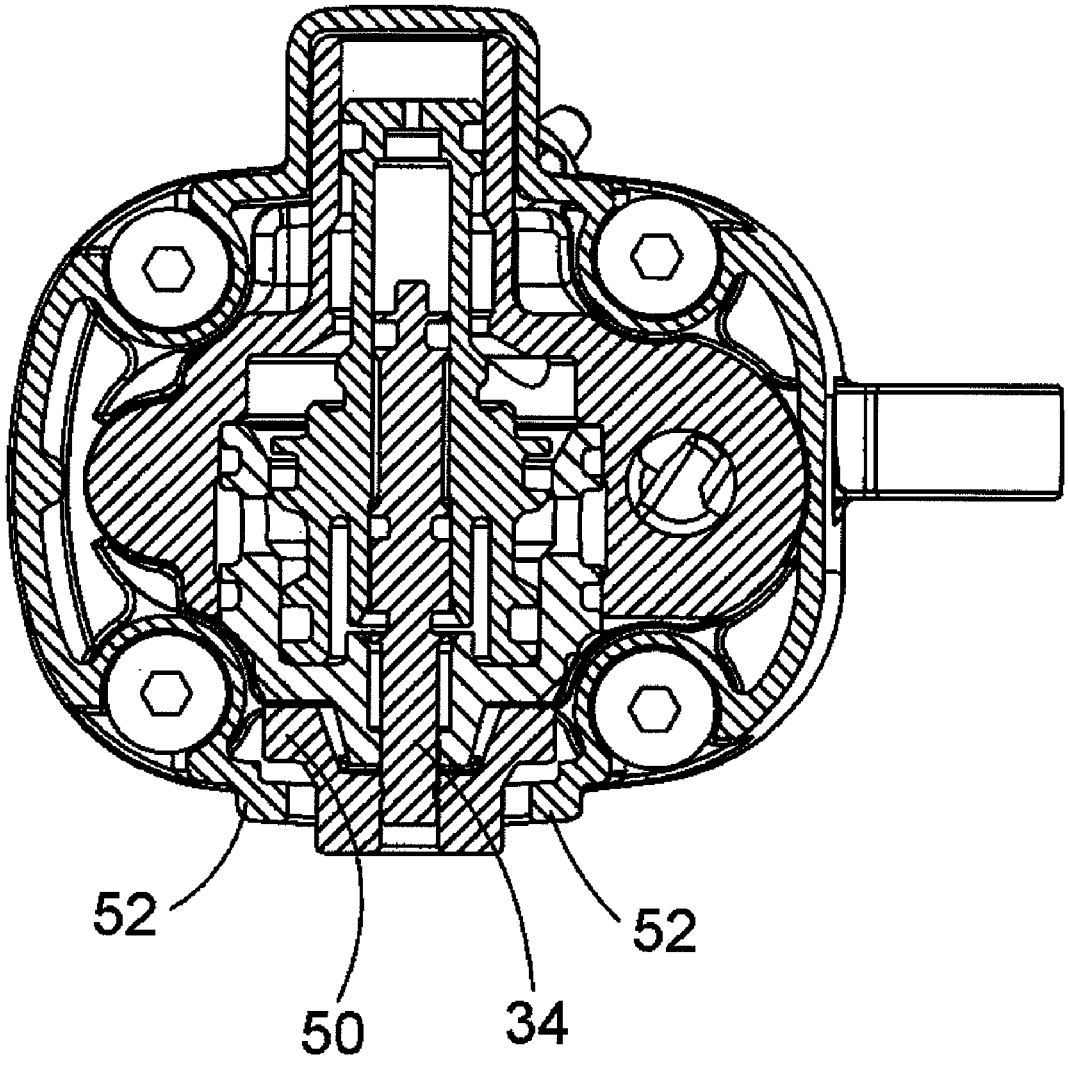
FIG. 10B is a locked state of the valve stem.

Next, FIGS. 9, 10A, 10B relate to a lock mechanism for the valve stem 34, and an inverted circular cone-shaped pinch button (an operating portion) 35 is provided at an outer end portion of the valve stem 34. An outwardly projecting mark 34*a* is formed on one side of a lower end of the pinch button 35, and an engagement piece 50 which projects to both sides is formed at an upper portion of the pinch button 35. In contrast to this, a receiving recess portion 51, which permits an upward movement of the pinch button 35, is formed at a lower portion of the valve housing 21, and a receiving piece 52, which can be brought into engagement with the engagement piece 51, is formed inside the receiving recess portion 51 in such a manner as to project inwards.

When the valve stem 34 lies in a lower position, the engagement piece 53 and the receiving piece 52 are set in such a position that they do not interfere with each other.

When using the air duster, the valve stem 34 may be pushed in together with the pinch button 35. When using the air duster for a short period of time, in the event that the hand is removed from the valve stem 34 after having used the air duster, the valve stem 34 returns to its original lower position.

In contrast to this, when using the air duster for a long period of time, the pinch button 35 may be rotated through 90 degrees after having pushed in the pinch button 35. By this action, since the engagement piece 50 moves round to a back side of the receiving piece 52 as is shown in FIG. 10B, the engagement piece 50 is engaged with the receiving piece 52 and the valve stem 34 is held in the same position, whereby the valve stem 34 is locked in a pushed-in state. Consequently, the air duster can be used for a long period of time without continuing to push the valve stem 34.

Figure 11:
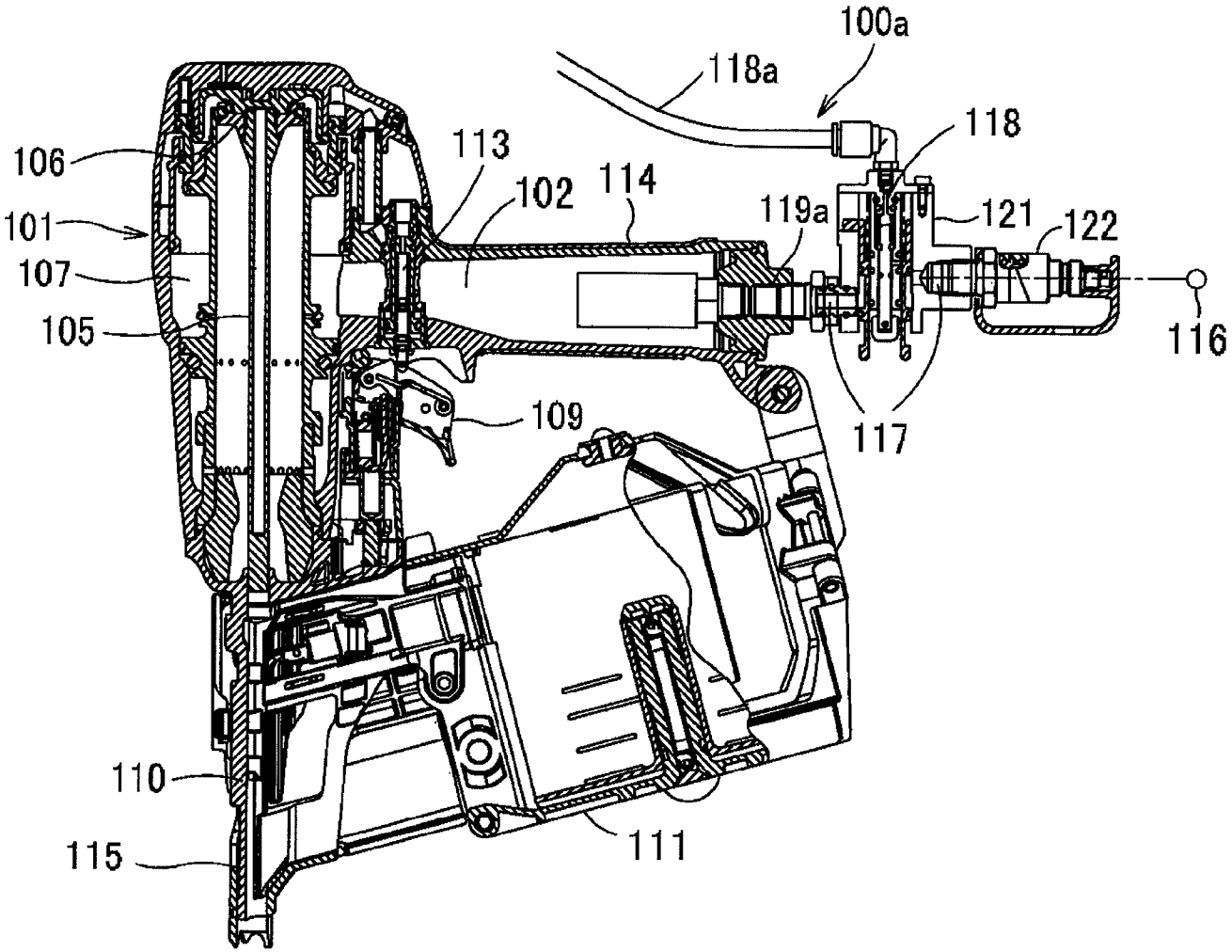
FIG. 11 is a vertical sectional view of a nailing machine according to an embodiment of the invention.
Figure 12:
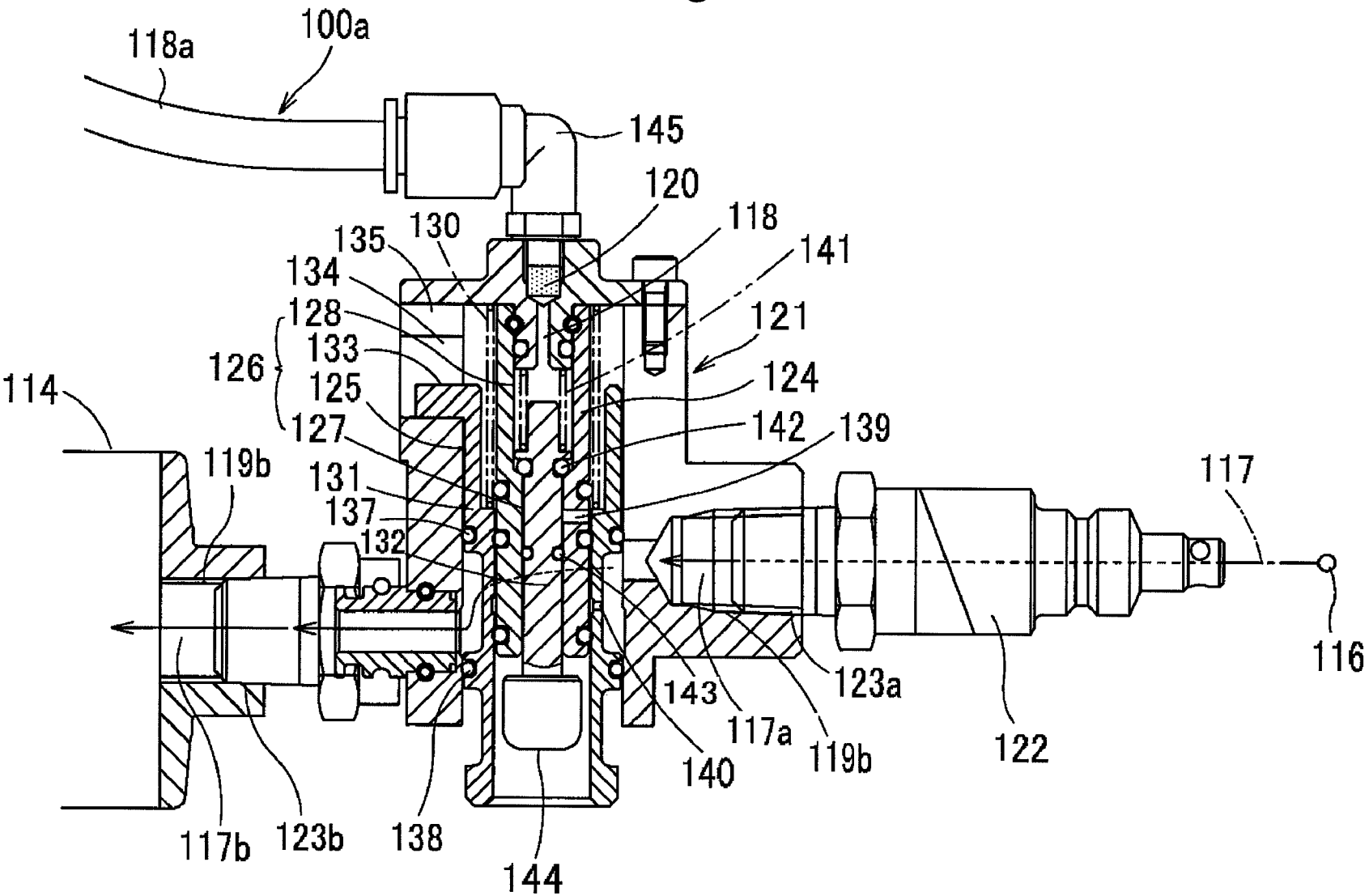
FIG. 12 is an enlarged sectional view of an initial state of a selector valve mechanism.
Figure 13:
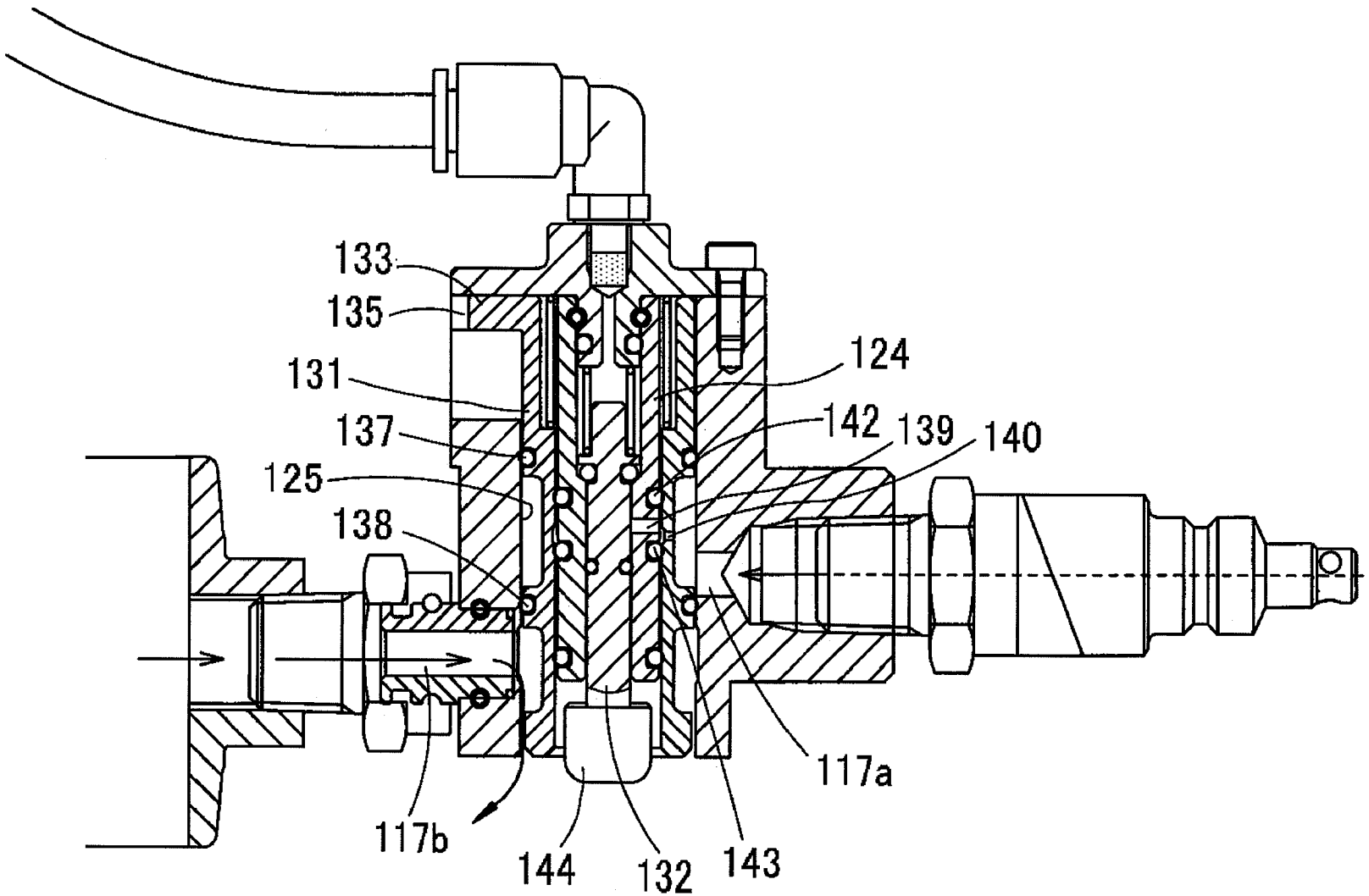
FIG. 13 is a sectional view depicting an operating state of a third selector valve.
Figure 14:
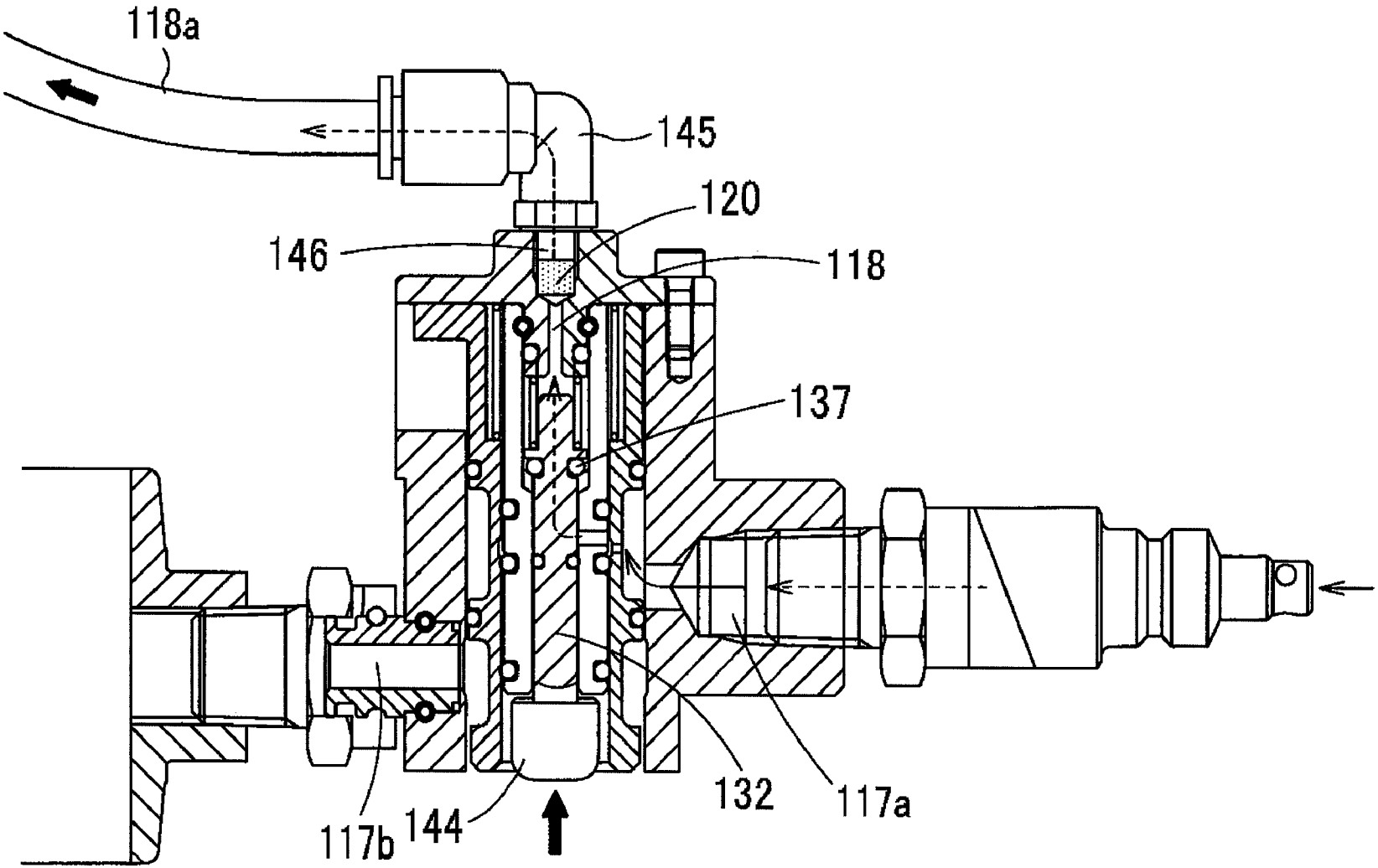
FIG. 14 is a sectional view depicting an operating state of a fourth switch valve.

FIG. 11 is a vertical sectional view of a nailing machine, FIG. 12 is an enlarged sectional view of an initial state of a selector valve mechanism, FIG. 13 is a sectional view depicting an operating state of a first selector valve, and FIG. 14 is a sectional view depicting an operating state of a second selector valve.

A hitting mechanism made up of a hitting piston 106 with which a driver 105 for hitting a nail by making use of compressed air accumulated within an air chamber 102 is connected and a hitting cylinder 107 which accommodates the hitting piston 106 slidably or the like is provided in a nailing machine main body 101 of the nailing machine, and a nose part 110 is provided below the nailing machine main body 101 which accommodates the hitting mechanism. A magazine 111 is installed consecutively at the rear of the nose part 110 via an opening. Nails within the magazine 111 are configured to be fed sequentially to an inside of the nose part 110 by a nail supply mechanism (not shown).

In addition, a trigger valve 113 is provided in the nailing machine man body 101 for driving the hitting mechanism so as to drive the hitting piston 106 by introducing compressed air within the air chamber 104 into the hitting cylinder 107 so as to activate the nailing machine. This trigger valve 113 is configured in such a manner as to introduce compressed air into the hitting cylinder 107 so as to drive the hitting piston 106 to thereby drive out a nail within the nose part 110 therefrom by driving the hitting mechanism through two operations of pulling a trigger lever 109 which is disposed at a lower portion of a grip part 114 and pressing a contact arm 115 against a surface of a material into which nails are to be driven.

Next, compressed air is configured in such a manner as to be taken into the air chamber 104 via an opening (a female screw portion) 119*a* at an end portion of the grip part 114 from an air supply source 116 such as an air compressor through an air duct 117. Then, a duct 118 which communicates with an air duster 100*a* via a selector valve mechanism (a valve mechanism) is formed in such a manner as to branch off at an intermediate portion along the length of the air duct 117. The air duster branch duct 118 is made up of a tubular metal instrument 145 and an air tube 118*a*, a compressed air outlet nozzle (not shown) is attached to a distal end thereof, and the air duster branch duct 118 is held in an appropriate position on the nailing machine.

The selector valve mechanism is provided in a valve housing 121. Specifically, as is shown in FIG. 12, a female screw portion 119*a* which can be screwed on to a thread portion 123*a* of an air plug 122 which connects to an air coupler (not shown) provided at an end portion of the air duct 117 from the air supply source 116 is formed at one end of the valve housing 121, and a screw portion 123 whose thread portion can be screwed into an opening 119*b* in the grip part 114 is formed at the other end thereof. In addition, the air duster branch duct 118 is formed at an intermediate upper portion thereof in such a manner as to branch off thereat. A filter 120 is provided at a proximal portion of the air duster branch duct 118.

In addition, a valve accommodation space is formed in a central portion of the valve housing 121, and further, a cylindrical wall 124 is formed in an interior of the valve accommodation space, whereby an outer valve accommodation portion 125 and an inner valve accommodation portion 126 are formed concentrically.

An upstream side duct 117*a* which communicates with the air supply source 116 and a downstream side duct 117*b* which communicates with a pneumatic tool are made to open to an inner surface of the outer valve accommodation portion 125 which are opposite to each other. The inner valve accommodation portion 126 is such that an inside diameter of an upper end portion is formed to be larger than an inside diameter of a portion which lies lower than an intermediate portion thereof, that a communication hole 139 which is made to open to a small diameter portion 127 at the intermediate portion is formed in a cylindrical wall 124 in such a manner as to penetrate therethrough, and that an upper end of a large diameter portion 128 communicates with the air duster branch pipe 118. In addition, the outer valve accommodation portion 125 and the inner valve accommodation portion 126 are made to open to the atmosphere at lower ends thereof.

Figure 15A:
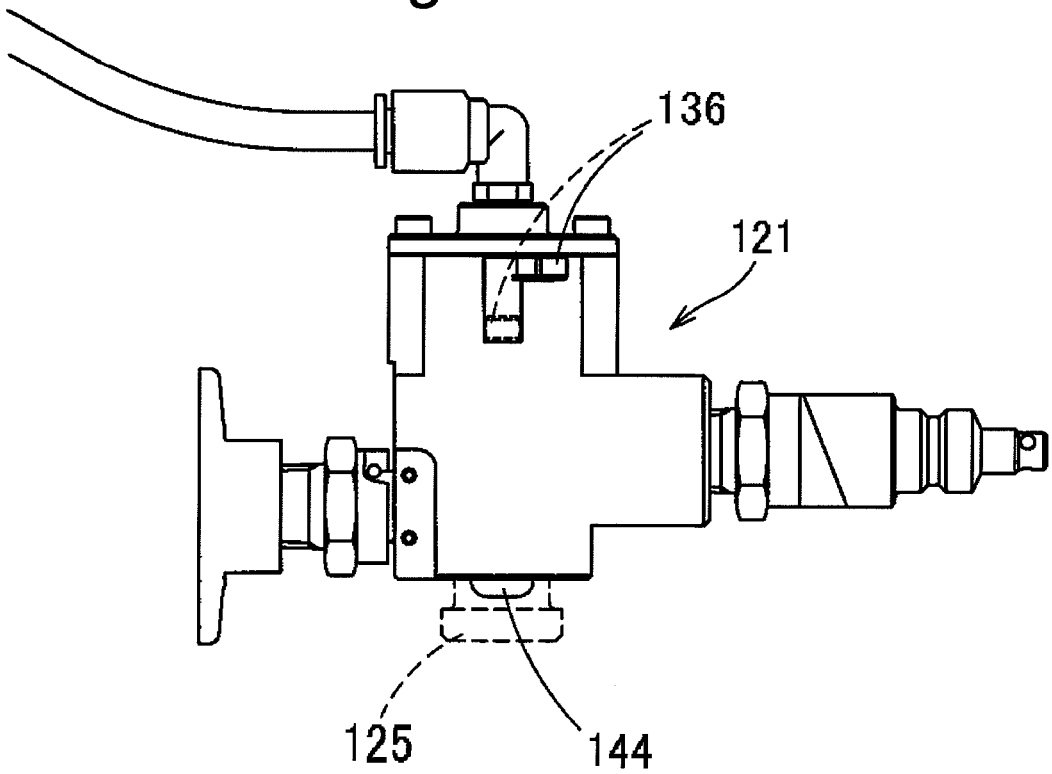
FIG. 15A is a side view of the selector valve mechanism.
Figure 15B:
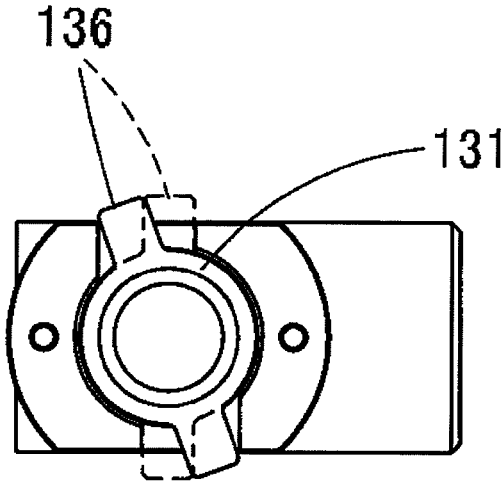
FIG. 15B is a bottom view of the selector valve mechanism.

A third selector valve 131 is accommodated slidably in the outer valve accommodation portion 125 and is biased in such a manner as to shift downwards by a spring 130. The third selector valve 131 is formed into a cylindrical shape, and at an upper end thereof, an engagement piece 133 comes into an elongated hole 134 formed in the valve housing 121. In addition, an engagement groove 135 is formed in an upper end of a side wall of the elongated hole 134 in such a manner that the engagement piece 133 is brought into engagement therewith when the third selector valve 131 is rotated horizontally. In relation to this, as is shown in FIGS. 15A, 15B, a knob 136 is formed at an upper end of the third selector valve 131 in such a manner as to project outwards of the valve housing 121. By rotating this knob 136, the engagement piece 133 can be engaged with and disengaged from the engagement groove 135.

An upper O ring 137 and a lower O ring 138 are provided circumferentially on an outer circumferential surface of an intermediate portion of the third selector valve 131, and a through hole 140 is formed between the upper and lower O rings 137, 138 on an upstream side. In addition, the third selector valve 131 is configured in such a manner that when it is shifted vertically, the third selector valve 131 opens and closes the upstream side duct 117*a* which communicates with the air supply source 116 relative to the downstream side duct 117*b* which communicates with the pneumatic tool.

A fourth selector valve 132 is accommodated slidably in the inner valve accommodation portion 126 and is biased in such a manner as to shift downwards by a spring 141. The fourth selector valve 132 is formed into a stem-like shape, and a color portion is formed at an upper portion thereof in such a manner as to fit in the large diameter portion 128 of the inner valve accommodation portion 126, an upper O ring 142, which can be brought into engagement with an upper end of the small diameter portion 127, being attached to a lower portion of the collar portion. In addition, a lower O ring 143 is attached to an intermediate portion of the fourth selector valve 132.

Since an operating button 144 of the fourth selector valve 132 is in a position which lies upper than a lower end of the third selector valve 131 and moreover sinks into an inside thereof, the operating button 144 is normally in a state in which the operating button 144 cannot be operated from the outside. When the third selector valve 131 shifts upwards, the operating button 144 of the fourth selector valve 132 comes to appear therefrom, and therefore, the operating button 144 can be operated to be pushed in upwards, whereby the upstream side duct 117*a* is configured in such a manner as to be opened and closed relative to the air duster branch duct 118 by upper and lower motions of the operating button 144.

Next, a mode of operation of the valve mechanism will be described.

Normally, as is shown in FIG. 12, both the third selector valve 131 and the fourth selector valve 132 are biased to lower positions. In this state, since the upstream side duct 117*a* and the downstream side duct 117*b* are made to open to somewhere between the upper and lower O rings 137, 138 of the third selector valve 131, the upstream side duct 117*a* is made to open to the downstream side duct 117*b*, whereby compressed air is supplied to the nailing machine. In contrast to this, since the through hole 139 of the inner valve accommodation portion 126 is made to open to somewhere between the upper and lower O rings 142, 143 of the fourth selector valve 132, the upstream side duct 117*a* is shut relative to the air duster branch pipe 118, whereby no compressed air is supplied to the branch duct 118. Consequently, in this state, only the nailing machine can be used.

When using the air duster, firstly, the third selector valve 131 is caused to shift upwards manually, and as is indicated by solid lines in FIGS. 15A, 15B, the knob 136 is caused to rotate and the engagement piece 133 is brought into abutment with engagement with the engagement groove 135 as is shown in FIG. 13, whereby the third selector valve 131 is held in the upper position. Since the upper and lower O rings 137, 138 of the third selector valve 131 are disengaged from an opening in the downstream side duct 117*b* by this series of actions, the upstream side duct 117*a* is shut relative to the downstream side duct 117*b*. At the same time, since the downstream side duct 117*b* is made to open to the opening at the lower end of the outer valve accommodation portion 125, compressed air remaining in the nailing machine is discharged to the atmosphere as indicated by arrows. In addition, although a through hole 140 in the third selector valve 131 and the through hole 139 in the cylindrical wall 124 communicate with each other, compressed air is only supplied between the upper and lower O rings 142, 143 of the fourth selector valve 132. Consequently, even if the third selector valve 131 is merely caused to shift upwards and downwards, the upstream side duct 117*a* is shut relative to either of the downstream side duct 117*b* and the air duster branch pipe 118.

Incidentally, when the third selector valve 131 lies in an upper position, as is shown in FIGS. 13 and 15A, the operating button 144 of the fourth selector valve 132 is exposed for operation. Then, when the fourth selector valve 132 is operated to be pushed up manually, since the upper O ring 137 of the third selector valve 131 moves away from an upper end of the small diameter portion 127 as is shown in FIG. 14, the upstream side duct 117*a* communicates with the air duster branch duct 118. Consequently, compressed air passes through the filter 120 so as to be forced out from the nozzle at the distal end of the branch duct 118 via the air tube 118*a*. Since the air tube 118*a* is light, air can lightly be blown at an aimed position.

After the air duster has been used, the third selector valve 131 and the fourth selector valve 132 may only have to be shifted downwards so as to be returned to its initial position. Although the filter 120 gets dirty while it is used repeatedly, the filter 120 can be removed for simple replacement by removing a thread portion 146 of the tubular metal instrument 145 of the air duster branch pipe 118.

According to the configuration that has been described above, since compressed air from the air supply source 116 is supplied to only either of the nailing machine and the air duster 100*a* by the selector valve mechanism, there is no situation where the nailing operation is performed in such a state that the driving air pressure is low. Consequently, since neither nail driving failure nor driving piston's return failure is caused by the lack of output, nails can be driven well at all times irrespective of the use of the air duster 100*a*.

In addition, since the air duster branch duct 118 is disposed before the pneumatic tool, the selector valve mechanism and the actuation trigger lever are made difficult to be operated at the same time. In addition, when attempting to use the air duster, since the third selector valve 131 firstly has to be operated to shut the upstream side duct 117*a* which communicates with the air supply source 116 relative to the downstream side duct 117*b* which communicates with the nailing machine and further, the upstream side duct 117*a* has, thereafter, to be made to open to the air duster branch duct 118 by the fourth selector valve 132, an unforeseen accident is made difficult to occur.

Further, the third selector valve 131 and the fourth selector valve 132 have to be operated from the outside in order to use the air duster. Since the two-stage valve operation becomes necessary in the way described above, there is no situation where the valve mechanism is easily actuated, whereby the safety is enhanced.

Furthermore, even after the air plug 122 is pulled out from the air coupler in such a state that the fourth selector valve 132 has been operated to be pushed in, when compressed air remains in the nailing machine, the nailing machine can be actuated for operation. However, compressed air within the nailing machine is discharged by the third selector valve 131. Thus, since the nailing machine cannot be actuated by the residual pressure, it is safe.

Further, oil is supplied to the nailing machine for lubrication and prevention of rust when the nailing machine is initially used. However, since compressed air from the air supply source 116 is supplied directly to the air duster branch duct 118, there is no situation where the branch duct 118 gets dirty due to oil contents. In addition, even though oil contents or dirt exits, since the filter 120 is provided in the air duster branch pipe 118, compressed air is filtered by the filter 120. Because of this, there is no situation where when compressed air is blown against a material into which nails are to be driven, oil contents or dirt adheres to the surface of the material.

In addition, since the valve mechanism has a function to regulate the flow rate of compressed air by selecting the pore size of the filter 120, air under an appropriate pressure can be forced out from the air duster without providing any special pressure reducing valve.

Moreover, by a tread portion 123*b* of the air plug 122 being configured in such a manner as to be screwed into the opening (the female screw portion) 119*a*119*a* in the grip part 114, the valve housing 121 can be retrofitted to an existing nailing machine.

In addition, as with the third selector valve 131, the fourth selector valve 132 may also be configured in such a manner as to be held in its upper position when it is caused to shift upwards. For example, although not shown, as with the third selector valve 131 and the elongated hole 134, the engagement groove 135 and the engagement piece 133 of the valve housing 121, a configuration may be adopted in which an engagement piece is made to project from the operating button 144 of the fourth selector valve 132, a guide groove in which the engagement piece can be shifted vertically is formed in the third selector valve 131, and an engagement groove with which the fourth selector valve 132 is brought into engagement when it is caused to shift upwards and is then rotated in a horizontal direction is formed in part of the guide groove. By this configuration, since the nailing machine can be held by one hand and the air tube can be manipulated by the other hand when the air duster is used, it is convenient.

It should be noted that the pneumatic tool is not limited to the nailing machine. The pneumatic tool can be any tool which is to be driven by making use of compressed air, and hence, the pneumatic tool may be, for example, a screw driver, an impact driver and the like.

While the invention has been described in detail and by reference to the specific embodiments, it is apparent to those skilled in the art to which the invention pertains that various changes or modifications can be made to the invention without departing from the spirit and scope of the invention.

The present patent application is based upon Japanese Patent Application (No. 2006-31192) which was filed on Dec. 7, 2006 and Japanese Patent Application (No. 2006-331193) which was filed on Dec. 7, 2006, and the contents thereof are to be incorporated herein by reference in their entireties.

The invention claimed is:

1. A pneumatic tool with an air duster comprising:

an upstream side duct which communicates with an air supply source of compressed air;

a downstream side duct which communicates with the pneumatic tool;

an air duster branch duct; and a valve mechanism which switches a flow path from the upstream side duct between the branch duct and the downstream side duct, wherein the valve mechanism comprises:

a selector valve which is capable of shifting to a first position where the selector valve opens the upstream side duct to the downstream side duct and shuts the upstream side duct relative to the branch duct and a second position where the selector valve opens the upstream side duct to the branch duct and shuts the upstream side duct relative to the downstream side duct;

an operating member which operates the selector valve from the outside; and a valve housing which communicates with the upstream side duct, the downstream side duct and the branch duct, wherein the selector valve comprises a cylindrical valve which is disposed slidably in an interior of the valve housing, and wherein the operating member comprises a valve stem which is fitted slidably in an interior of the selector valve, in which an operating portion at one end thereof penetrates the valve housing to project to the outside, which selectively opens a space formed on one end side of the selector valve to the upstream side duct or the atmosphere, and which causes the selector valve to shift to the first position or the second position.

2. The pneumatic tool with the air duster according to claim 1, wherein the valve mechanism comprises further a filter which is provided in the branch duct.

3. The pneumatic tool with the air duster according to claim 1, wherein the selector valve comprises a large diameter portion and a small diameter portion on an outer circumferential surface thereof, and wherein the downstream side duct is made to open to somewhere midway between the large diameter portion and the small diameter portion, whereby when the upstream side duct is made to open to the atmosphere in such a state that the selector valve is situated as a result of operation of the valve stem in the position where the selector valve shuts the upstream side duct relative to the downstream side duct and the selector valve opens to the branch duct, a residual pressure in the downstream side duct is made to act on the large diameter portion and the small diameter portion to thereby cause the selector valve to shift to the first position side.

4. The pneumatic tool with the air duster according to claim 1, wherein the valve stem comprises on an outer circumferential surface thereof a large diameter portion and a small diameter portion which is slightly smaller in diameter than the large diameter portion, and wherein an end portion of the valve stem is made to open to the atmosphere at an opposite side to the operating portion of the valve stem, whereby when compressed air from the upstream side duct is supplied between the large diameter portion and the small diameter portion in the midst of the valve stem being pushed in by the operating portion, a load against the push-in of the valve stem is made small.

5. The pneumatic tool with the air duster according to claim 1, further comprising a lock mechanism which locks the valve stem in a state in which the valve stem has been slid to be operated.

6. The pneumatic tool with the air duster according to claim 1, further comprising an outlet nozzle which forces out compressed air of the air duster which can rotate about an axis of the branch duct.

7. The pneumatic tool with the air duster according to claim 6, wherein compressed air from the outlet nozzle of the air duster is made to be forced out to the periphery of a working range extending from a front end to a rear end of the pneumatic tool.

8. A pneumatic tool with an air duster comprising:

an upstream side duct which communicates with an air supply source of compressed air;

a downstream side duct which communicates with the pneumatic tool;

an air duster branch duct; and a valve mechanism which switches a flow path from the upstream side duct between the branch duct and the downstream side duct, wherein the valve mechanism comprises:

a first selector valve which opens and closes the upstream side duct to the downstream side duct; and a second selector valve which opens and closes the upstream side duct relative to the branch duct in such a state that the first selector valve shuts the upstream side duct relative to the downstream side duct.

9. The pneumatic tool with the air duster according to claim 8, wherein the first selector valve and the second selector valve can be provided in such a manner as to be operated from the outside.

10. The pneumatic tool with the air duster according to claim 8, wherein when the first selector valve shuts the upstream side duct relative to the downstream side duct, the downstream side duct is made to open to the atmosphere.

11. The pneumatic tool with the air duster according to claim 8, further comprising a filter which is provided in the branch duct.

* * * * *